US007251442B2

(12) United States Patent
Sato et al.

(10) Patent No.: US 7,251,442 B2
(45) Date of Patent: Jul. 31, 2007

(54) COLOR IMAGE FORMING APPARATUS HAVING ADVANCED TRANSFER SYSTEM

(75) Inventors: Yotaro Sato, Hachioji (JP); Takenobu Kimura, Hachioji (JP); Hiroshi Akita, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 17 days.

(21) Appl. No.: 11/113,059

(22) Filed: Apr. 25, 2005

(65) Prior Publication Data

US 2006/0051138 A1 Mar. 9, 2006

(30) Foreign Application Priority Data

Sep. 8, 2004 (JP) ..... 2004-260635

(51) Int. Cl.
*G03G 15/16* (2006.01)

(52) U.S. Cl. ..... 399/296; 399/72; 399/66; 399/302

(58) Field of Classification Search ..... 399/66, 399/72, 73, 296, 302, 314, 315
See application file for complete search history.

(56) References Cited

U.S. PATENT DOCUMENTS 5,983,060 A * 11/1999 Namekata et al. ..... 399/66
2001/0010768 A1* 8/2001 Furuya et al. ..... 399/296

FOREIGN PATENT DOCUMENTS

| | | |
|---|---|---|
| JP | 8-114993 | 5/1996 |
| JP | 9-098067 | 10/1998 |
| JP | 11-143255 | 5/1999 |
| JP | 2001-235947 | 8/2001 |
| JP | 2002-123092 | 4/2002 |

* cited by examiner

*Primary Examiner*—David M. Gray
*Assistant Examiner*—Laura K Roth
(74) *Attorney, Agent, or Firm*—Finnegan, Henderson, Farabow, Garrett & Dunner, L.L.P.

(57) ABSTRACT

An image forming apparatus having an intermediate transfer body in which color toner images are superimposed on the intermediate transfer body is disclosed. Additionally, the toner image potential may be suppressed in areas with large toner electrostatic charge of the toner layer on the intermediate transfer body, while the toner image potential is left as such in the low toner adhesion areas. The image forming apparatus with a neutralizing charger is capable of yielding satisfactory second transfer images without causing image roughness or toner scattering.

8 Claims, 3 Drawing Sheets

COLOR IMAGE FORMING APPARATUS HAVING ADVANCED TRANSFER SYSTEM

CROSS REFERENCE TO RELATED APPLICATION

The present application is based on Japanese Patent Application No. 2004-260635 filed with Japan Patent Office on Sep. 8, 2004.

BACKGROUND OF THE INVENTION

1. Field of the Invention

The present invention relates to copying machines, printers, facsimiles, and color image forming apparatuses employing the electrophotographic method having these functions, and in particular to color image forming apparatuses that have an intermediate transfer body and in which color toner images are superimposed on that intermediate transfer body.

2. Description of Related Art

Color image forming apparatuses of the electro-photographic method have been known which employ an intermediate transfer body, the toner image formed on the image supporting body which is the photosensitive body is transferred to the intermediate transfer body, and the toner image on that intermediate transfer body is transferred onto the transfer medium (also called recording paper or simply paper). In such a color image forming apparatus, after the toner images formed successively on the image supporting body and charged to a specific electrostatic voltage are first transferred one toner image upon the other onto the intermediate transfer body using electrostatic force, the toner images on that intermediate transfer body is collectively transferred onto the transfer medium using electrostatic force.

Since the amount of charge per toner particle is almost uniform, the potential on the intermediate transfer body is determined by the amount of toner adhered within a specific area, the electric surface potential of the part of the intermediate transfer body of a color image forming apparatus in which toners of several colors have been superimposed will be larger than the electrostatic surface potential of the area in which toner of only one color is adhered.

When the variation in the potential is large on the intermediate transfer body after primary transfer, it becomes easy for different types of image defects to occur at the time of second transfer and methods in which the electrostatic charge of the toner on the intermediate transfer body is made uniform thereby carrying out uniform second transfer have been proposed in, for instance, Japanese Unexamined Laid-Open Patent No. Hei 10-274892 and Japanese Unexamined Laid-Open Patent Publication No. Hei 11-143255.

In these Japanese Patent Publications, since the quantity of electrostatic charge of the toner on the intermediate transfer body has been made uniformly large in a low humidity environment or when the resistance of the paper is high, image defects due to electrostatic discharge caused by increase in the potential of the paper are more likely to occur at the time of the second face image transfer in the both-sides copy mode, and if the transfer voltage is made low in order to avoid such image defects there will be insufficient transfer electric field in the part of the toner layer with large total electrostatic charge thereby causing density variations or toner scattering around the edges of the image.

In order to prevent transfer defects due to too large total electrostatic charge of the toner layer, although, prior technology exists in which a uniform discharge is made to the polarity opposite to that of the toner image potential for all the image areas using corona discharge, but in this case the toner image potential in the part with large amount of toner adhesion has been suppressed in an appropriate value thereby obtaining satisfactory images, the toner image potential would be too low in the image area with low quantity of toner adhesion such as half-tone areas, and in some cases the potential could get reversed thereby causing image defects such as image roughness, toner scattering, etc.

SUMMARY

The purpose of the present invention is to provide an image forming apparatus in which it is possible to form high quality images on the recording medium.

Another purpose of the present invention is to provide a color image forming apparatus in which the toner image potential is suppressed in areas with large toner electrostatic charge of the toner layer on the intermediate transfer body while the toner image potential is left as such in the low toner adhesion areas such as half-tone areas, thereby providing a color image forming apparatus with a neutralizing charger capable of yielding satisfactory second transfer image without causing the image roughness or toner scattering.

To attain at least one of the above mentioned objects, an image forming apparatus according to the embodiment of the present invention includes: an image forming section for forming a toner image with toner particles having a first electric polarity; an intermediate transfer body for bearing the toner image; a first transfer section for transferring the toner image from the image forming section to the intermediate transfer body; a second transfer section for transferring the toner image from the intermediate transfer body to a recording medium; a charger for applying an electric charge to the toner image on the intermediate transfer body before the toner image is transferred to the recording medium, the charger having a discharge electrode and a grid electrode; and a charge control section for applying a first voltage and a second voltage to the discharge electrode and the grid electrode, respectively, the first voltage having a second electric polarity that is a reversed polarity of the first electric polarity, the second voltage having an electric potential between a first electric surface potential of the intermediate transfer body where no toner particle is adhered and a second electric surface potential of a portion where toner particles are maximally adhered on the intermediate transfer body.

The other image forming apparatus according to the embodiment of the present invention includes: an image forming section for forming a toner image with toner particles having a first electric polarity; a second transfer section for transferring the toner image to a recording medium; a charger for applying an electric charge to the toner image before the toner image is transferred to the recording medium, the charger having a discharge electrode and a grid electrode; a sensor for sensing a first electric surface potential of a background part of the toner image and a second electric surface potential of a certain density part of the toner image; a charge control section for applying a first voltage and a second voltage to the discharge electrode and the grid electrode, respectively, based on the first and second electric surface potentials sensed by the sensor.

Another image forming apparatus according to the embodiment of the present invention includes: an image forming section for forming a toner image with toner particles having a first electric polarity; an intermediate transfer body for bearing the toner image; a first transfer section for transferring the toner image from the image forming section to the intermediate transfer body; a second transfer section for transferring the toner image from the intermediate transfer body to a recording medium; a charger for applying an electric charge to the toner image on the intermediate transfer body before the toner image is transferred to the recording medium; and a charge control section for applying a voltage to the charger, the voltage being suitable for lowering an electric surface potential of a high density portion of the toner image and for substantially preventing an electric surface potential of a low density portion of the toner image from lowering.

BRIEF DESCRIPTION OF THE DRAWINGS

These and other objects, advantages and features of the invention will become apparent from the following description thereof taken in conjunction with the accompanying drawings in which.

PREFERRED EMBODIMENT OF THE INVENTION

Although a preferred embodiment of the present invention is described in the following, the scope of the present invention shall not be limited to the preferred embodiment described here.

Figure 1:
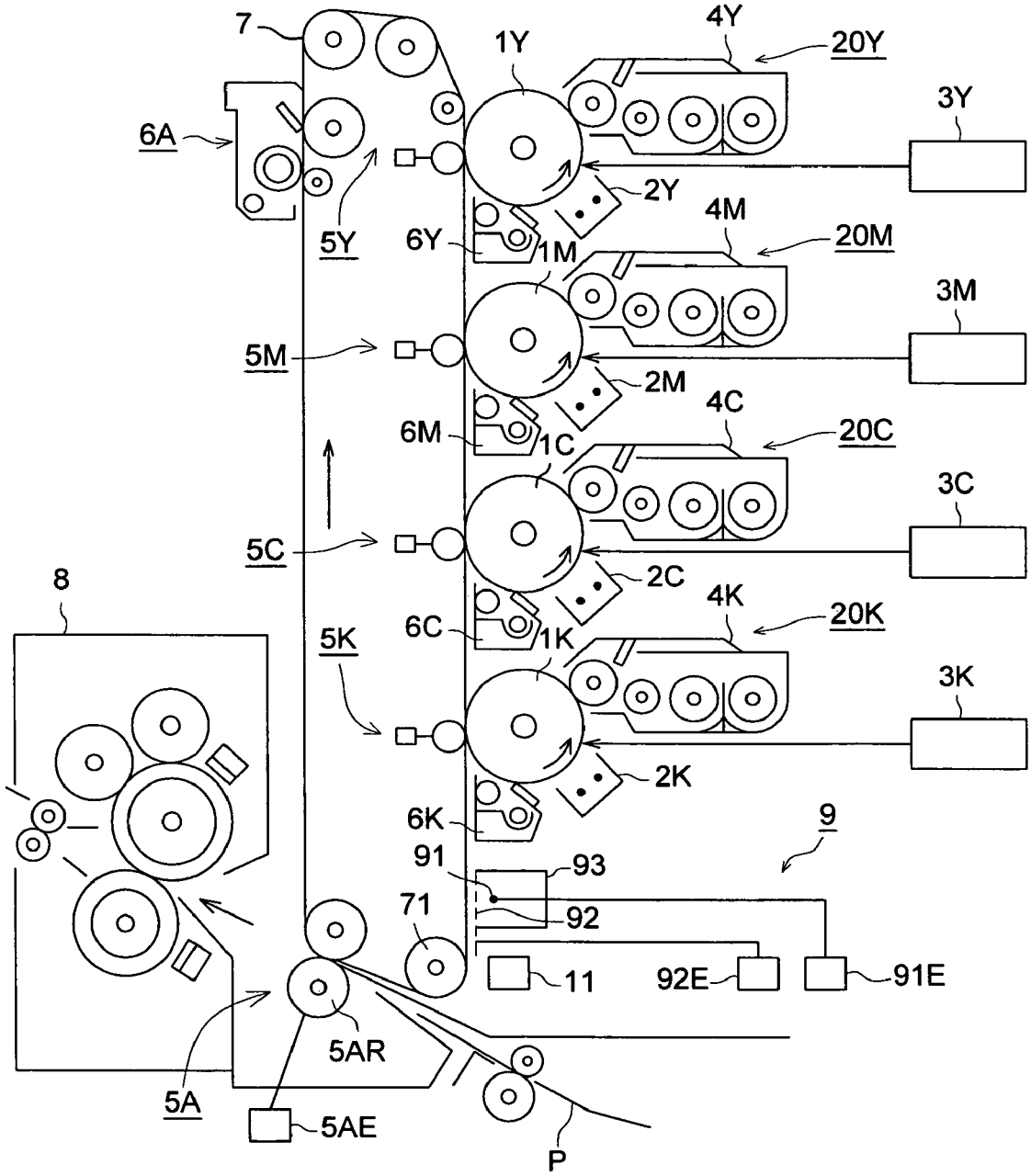
FIG. 1 is a configuration diagram of the color image forming apparatus.

FIG. 1 is a configuration diagram of the color image forming apparatus according to the present embodiment.

This color image forming apparatus is called the tandem type color image forming apparatus and comprises plural sets of image forming sections 20Y, 20M, 20C, and 20K, an intermediate transfer unit, a sheet transport unit, and a fixing unit 8.

The image forming unit 20Y that forms images of yellow color comprises the charging unit 2Y, the exposure unit 3Y, the developing unit 4Y, the primary transfer section 5Y, and the cleaning section 6Y, all of which are placed in the periphery of the photosensitive body 1Y which is the image supporting body. The image forming unit 20M that forms images of magenta color comprises the charging unit 2M, the exposure unit 3M, the developing unit 4M, the primary transfer section 5M, and the cleaning section 6M, all of which are placed in the periphery of the photosensitive body 1M which is the image supporting body. The image forming unit 20C that forms images of cyan color comprises the charging unit 2C, the exposure unit 3C, the developing unit 4C, the primary transfer section 5C, and the cleaning section 6C, all of which are placed in the periphery of the photosensitive body 1C which is the image supporting body.

The image forming unit 20K that forms images of black color comprises the charging unit 2K, the exposure unit 3K, the developing unit 4K, the primary transfer section 5K, and the cleaning section 6K, all of which are placed in the periphery of the photosensitive body 1K which is the image supporting body.

The belt shaped intermediate transfer body 7 is semiconductive, and is passed around and is supported so that it can move in a circulating manner by a plurality of rollers.

The image forming section comprising the charging unit 2Y, the exposure unit 3Y, and the developing unit 4Y carries out charging, exposure, and development of the photosensitive body 1Y thereby forming the yellow toner image on the photosensitive body 1Y. In a similar manner, the image forming section comprising the charging unit 2M, the exposure unit 3M, and the developing unit 4M carries out charging, exposure, and development of the photosensitive body 1M thereby forming the magenta toner image on the photosensitive body 1M, the image forming section comprising the charging unit 2C, the exposure unit 3C, and the developing unit 4C carries out charging, exposure, and development of the photosensitive body 1C thereby forming the cyan toner image on the photosensitive body 1C, and the image forming section comprising the charging unit 2K, the exposure unit 3K, and the developing unit 4K carries out charging, exposure, and development of the photosensitive body 1K thereby forming the black toner image on the photosensitive body 1K. These single colored toner images are transferred onto the intermediate transfer body 7 by the transfer rollers 5Y, 5M, 5C, and 5K, thereby forming the multicolored toner image by superimposing one image on the other.

Although an OPC photosensitive body or an amorphous silicon photosensitive body or any other widely known type of body is used as the photosensitive body 1 (1Y, 1M, 1C, and 1K), it is preferable to use an OPC photosensitive body, in particular, it is desirable to use a negatively chargeable OPC photosensitive body and hence a negatively chargeable OPC photosensitive body is being used in the present preferred embodiment.

Although a corona discharge unit such as a scorotron or a corotron can be used as a charging unit 2 (2Y, 2M, 2C and 2K), a scorotron discharge unit is used preferably.

A laser, LED array, or other light emitting device that emits light according to the image data is used as the exposure unit.

Although the developing unit 4 (4Y, 4M, 4C and 4K) used can be one that uses a dual component developed that includes a toner as the sole main component by does not contain a carrier, it is desirable to use a dual component developer that uses small particle diameter toner. In addition, although it is possible to use a developing unit that carries out normal development or a developing unit that carries out reversal development, it is preferable to carry out reversal development by applying a development by applying a development bias of the same polarity as the surface charging of the photosensitive body 1 on the developing sleeve and using a toner that is charged to the same polarity as the surface charge on the photosensitive body, and reversal development using a negatively charged toner is used in the present preferred embodiment.

It is desirable to use a small particle diameter toner with a volume average particle diameter of 3 μm to 6 μm.

The volume average particle diameter is the average particle diameter taking the volume as the basis, and is the value measured by a Coulter Counter TA-II or a Coulter Multisizer with a wet type disperser unit (both instruments manufactured by Beckman Coulter Inc. (CA)).

Using such small particle diameter toner, it is possible to form high quality images having high resolutions.

The high image quality feature becomes degraded when toners with volume average particle diameters larger than 6 μm are used.

When a toner with a volume average particle diameter smaller than 3 μm is used, the image quality is likely to get deteriorated due to fogging, etc.

In addition, in the present embodiment, it is desirable to use spherical shaped toners, and the toner is desirable that has the spherical degree of equal to or more than 0.94 and less than 0.98.

The spherical degree=(circumference of a circle with the same area as the particle projection)/(circumference of the particle projection). Said spherical degree is measured for 500 resin particles by taking a 500× enlarged photograph of the resin particle using a scanning electron microscope or a laser microscope and analyzing the photographed image using an image analyzing equipment (the Scanning Image Analyzer manufactured by JEOL, Ltd. (Tokyo, JAPAN)), and then obtaining the arithmetic mean value of the values for all the 500 particles. In addition, as a simplified measuring method, it is possible to measure using the FPIA-1000 (manufactured by Sysmex Corporation (Kobe, JAPAN)).

When the spherical degree is less than 0.94, the particles are crushed due to being subjected to large stresses in the developing unit and hence fogging or toner scattering become easy to occur. Further, when the spherical degree is higher than 0.98, it may become difficult to maintain high cleaning performance.

It is desirable to use polymer toners for said toners with small particle diameters and also high spherical degree.

Polymerization toners are toners obtained through the preparation of the binder resin for the toner, and the shape of the toner being formed by polymerization of the monomer or pre-polymer raw material of the binder resin and by further chemical reaction. In more concrete terms, they are toners obtained by polymerization reactions such as suspension polymerization or emulsion polymerization and, if necessary, the process of fusion of particles that is carried out thereafter. In polymerization toners, a toner with uniform particle distribution and shape is obtained by manufacturing the toner by polymerizing the raw material monomer or pre-polymer that is first dispersed uniformly in a water-based medium.

In more specific terms, fine polymerized particles are obtained by suspension polymerization or by emulsion polymerization of monomers in a liquid of water-based medium to which has been added an emulsifier, and thereafter, by the method of association by adding an organic solvent or a coagulant. At the time of association, there are the methods of carrying out association after mixing dispersion liquids such as releasing agents or coloring agents necessary for the composition of the toner, or of carrying out emulsion polymerization after dispersing the toner component materials such as releasing agents or coloring agents into the monomer. Here, the word association implies the fusion of several particles of the resin and the coloring agent.

Indicated by 5A is the second image transfer section which comprises the transfer roller 5AR which is an electrically conductive rubber roller and the power supply 5AE.

Indicated by 6A is the intermediate transfer body cleaning section that cleans the intermediate transfer body 7, and 8 is the fixing unit that fixes the toner image on the transfer material P.

The intermediate transfer body 7 is a single layer or a multiple layer belt made of polyimide etc. and has a volume resistivity in the range of $10^7$ to $10^{12}$ Ωcm, and a belt having a volume resistivity of $10^9$ Ωcm is used in the present preferred embodiment.

Further, after the toner image is secondary transferred to the transfer material P by the transfer roller 5AR, the intermediate transfer body 7 is passed through the intermediate transfer body cleaning section 6A where it gets cleaned.

In the present invention, a scorotron type neutralizing charger prior to second transfer section 9 having the grid function is provided between the primary transfer section 5K and the second transfer section 5A along the intermediate transfer body 7. This neutralizing charger section comprises the wire-shaped discharge electrode 91, the grid 92, and the side plate 93, the grid 92 is opposite the belt surface of the intermediate transfer body 7 maintaining a spacing of 1 mm with it, and grounded supporting rollers 71 are provided on the back surface of the intermediate transfer body 7. Further, the side plate 93 is connected to the same electric potential as the grid 92.

A DC bias voltage, of +5 kV DC voltage in the present preferred embodiment, having a polarity opposite to that of the toner and causing the discharge is applied to the discharge electrode 91 from the power source 91E, and a bias voltage corresponding to a potential between the surface potential of the toner image in an area where the maximum amount of toner has got adhered to the intermediate transfer body 7 and surface potential of the area of the intermediate transfer body 7 where no toner has got adhered to it is applied to the grid 92 from the power source 92E, and a bias voltage is applied in the present preferred embodiment so as to make this potential equal to −100 V.

Figure 2:
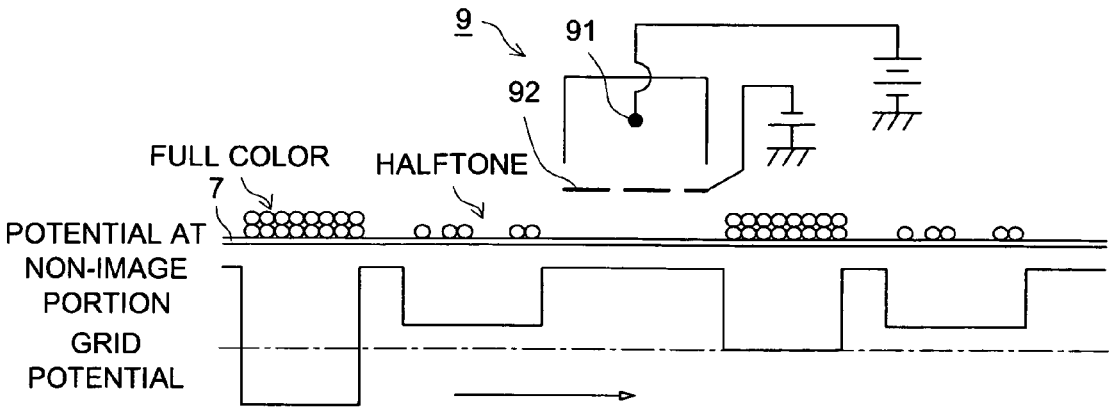
FIG. 2 is a schematic diagram showing the variations in the toner layer potential before and after passing through the neutralizing charger.

FIG. 2 is a schematic diagram showing the variations in the potential of the toner layer on the intermediate transfer body 7 before and after passing through the neutralizing charger section 9 to which a bias voltage has been applied. This figure indicates that although the potential is lowered in the full color area where a large quantity of toner has got adhered, the potential is maintained as it is in the half-tone area where a small quantity of toner has got adhered.

In the present preferred embodiment, a satisfactory second transfer image is being obtained on the paper by applying an image transfer bias voltage of +3 kV to the second transfer section 5A with regard to the toner image after having passed through the neutralizing charger section 9.

Figure 3:
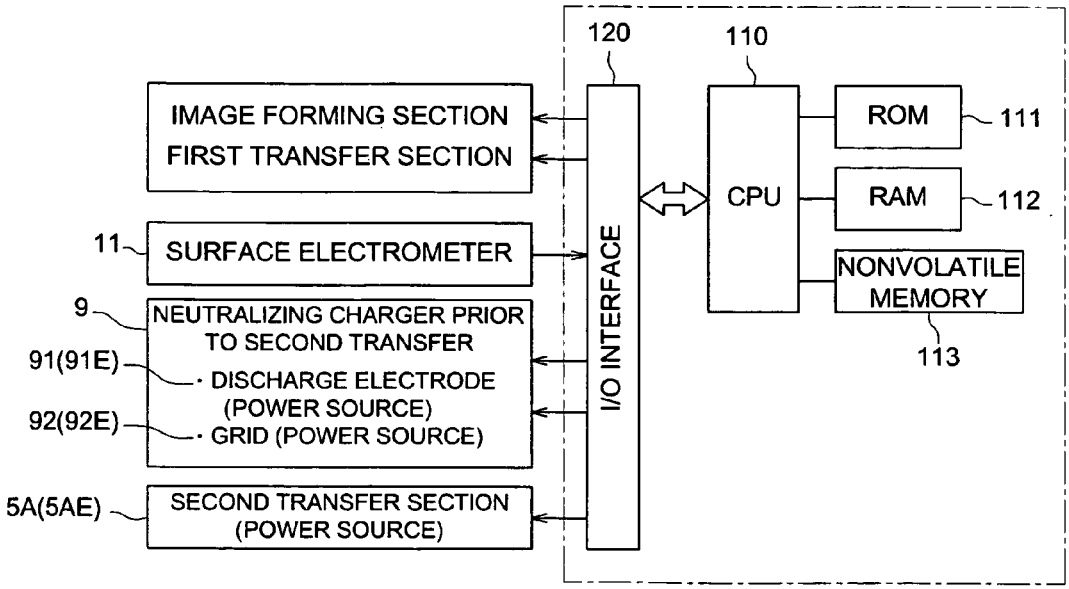
FIG. 3 is a block diagram showing the outline of the electrical control system.

FIG. 3 is a block diagram showing the outline of the electrical control system. Here, 110 is the CPU that carries out computer control processing to which are connected the ROM 111, the RAM 112, and the non-volatile memory 113. The ROM stores the basic data for the computations, the image forming mode program, the program of setting the conditions of the neutralizing charger section prior to the second transfer, and the non-volatile memory 113 stores the image pattern for test printing, and the lookup table for setting the neutralizing charger section conditions. The CPU 110 is connected to external devices via the interface 120.

The surface potential meter 11 etc. have been connected to the input port on the input side of the interface 120 as the potential detection section that detects the surface potential of the intermediate transfer body 7. In addition, apart from the image forming section, the discharge electrode 91 power supply of the neutralizing charger unit 9, the grid 92 power supply, and the second transfer section 5A power supply are connected respectively to the output ports on the output side of the interface 120.

An operation and display section is provided in the color image forming apparatus shown in FIG. 1, and when the Start button instructing the starting of the printing operation is pressed after inputting the size of the recording paper used and the number of copies to be printed, the CPU 110 calls the image forming mode program from the ROM 111, and carries out image formation corresponding to the set number of copies of the image data stored in the memory.

Although the bias voltages applied to the discharge electrode 91 and the grid 92 of the neutralizing charger unit 9 according to the present invention can be set manually by the service engineer at the time of installing the color image forming apparatus, they can also be set by calling the neutralizing charger prior to second transfer conditions setting program stored in the ROM 111.

Figure 4:
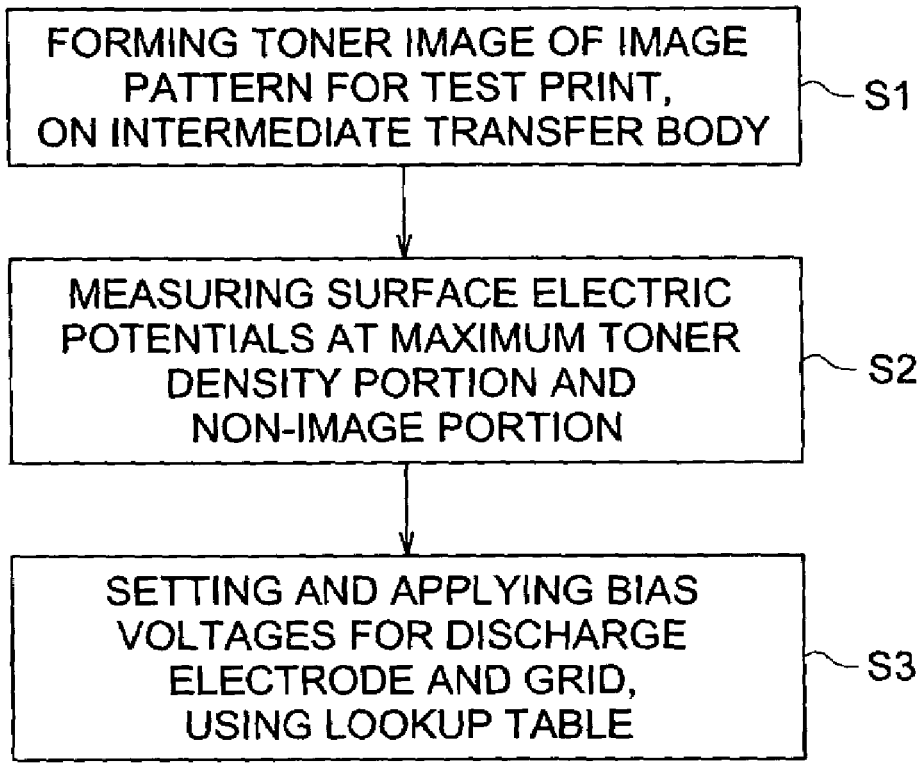
FIG. 4 is a flow chart showing the process of setting the neutralizing charger bias voltages.

FIG. 4 is a flow chart showing the voltage setting process of setting the neutralizing charger bias voltages applied to the discharge electrode 91 and to the grid 92 by the neutralizing charger prior to second transfer conditions setting program.

When the neutralizing charger prior to second transfer conditions setting mode is set, the CPU 110 carries out image formation after calling the image pattern for test printing consisting of areas with the maximum image density and areas with no image, and forms the toner image of the test print on the intermediate transfer body 7 (Step S1).

The surface potential at the area on the intermediate transfer body 7 where a maximum quantity of toner has been adhered and the surface potential at the area where there is no image formation are measured by the surface potential meter 11 (Step S2).

The CPU 110 calls the lookup table, and obtains the bias voltage to be applied to the discharge electrode 91 and the bias voltage to be applied to the grid 92 from the potential of the area where there is a maximum quantity of toner adhered and the potential of the area where there is no image formation, and makes the settings so that the bias voltages so obtained are applied to the neutralizing charger unit 9 at the time of image formation (Step S3).

In the present preferred embodiment, the surface electric potential meter 11 has measured a voltage of −205 V at the area of maximum toner density and a voltage of −10 V at the area with no image formation from the toner image of the test pattern and has made the settings so as to apply +5 kV to the discharge electrode 91 and −100V to the grid according to the values obtained from the lookup table. By setting the bias voltages to be applied to the neutralizing charger unit 9 at the time of image formation, it is possible to obtain good second transfer image with no image roughness or toner scattering.

Comparison Test:

The present inventors carried out the following comparison test using the color image forming apparatus shown in FIG. 1 and have confirmed the effect of the neutralizing charger prior to second transfer unit 9 according to the present embodiment.

The comparison tests were made at the following common conditions.

The tests were made in an environment of low temperature and low humidity (10° C., 20% RH).

The development is made for each of the colors Y, M, C, and K using dual component developer, and the toners used for each color were polymerization toners with volume average particle diameters of 3 μm to 6 μm. The toner charge measured for the adhered toner was −47 μC/g on the upstream side of the neutralizing charger unit 9 on the intermediate transfer body 7.

Because image roughness and discharge tracks can occur easily when the resistance value of the paper used is high, the paper used for the tests was 80 g/m$^2$ paper for color printing, and after a fully dark image (solid image) is formed and fixed on the first surface of the paper, and the evaluation was made for the toner image part of the image pattern of the test pattern after second transfer was made on the second surface of the paper.

The image pattern for test printing used during the comparison test was an image pattern provided with five stages of successively increasing steps comprising a full color section (the part with the maximum image density), a two-color section, a single color section, single color half-tone section, and a blank paper section (section with no image formation).

The potentials of the toner image area formed on the intermediate transfer body 7 due to the image pattern have been measured using a surface electric potential meter 11. During this test, two sets of surface electric potential meters were used with adjustments having been made in the measured values between them, these two surface electric potential meters were provided on the upstream side and on the downstream side close to the neutralizing charger unit 9 above the intermediate transfer body 7, and the surface electric potentials were measured using the two sets of surface electric potential meters 11 for each of the toner adhered areas before passing through the neutralizing charger unit 9 and after passing through the neutralizing charger unit 9.

The toner image of the test pattern on the intermediate transfer body 7 after passing through the neutralizing charger 9 was transferred onto the second surface of said paper for testing by the second image transfer section with the respective appropriate bias voltages applied, and the toner images after the transfer onto the paper were evaluated.

Further, the surface electric potential at the non-image forming area of the intermediate transfer body 7 was −10 V.

Preferred Embodiment

The test was carried out by applying a DC bias voltage of +5 kV to the discharge electrode 91 of the neutralizing charger section 9 and by applying a bias voltage of −100V to the grid 92.

TABLE 1

| | | Full color | Two colors | Single color | Single color half-tone |
|---|---|---|---|---|---|
| Toner layer surface electric potential before the neutralizing charge | | −205 | −172 | −92 | −31 |
| Toner layer surface electric potential after the neutralizing charge | | −132 | −120 | −92 | −31 |
| Image quality | Second transfer 3 kV | Good | Good | Good | Good |

As is shown in Table 1, the charge on the toner has decreased in the part of the toner layer with high surface electric potentials due to the discharge by the neutralizing charger 9. Because of this, it was possible to obtain uniform images with no discharge tracks or with no image density variations and no toner scattering on the border of the image even after second image transfer. Further, the toner layer surface electric potentials at the parts of the image with low surface electric potentials almost does not change compared to the values before passing through the neutralizing charger, and also there is no image undulations in the half-tone areas of the image. Therefore, satisfactory image was obtained in the areas of the image with all quantities of toner adhesion.

COMPARATIVE EXAMPLE 1

The test was carried out in the neutralizing discharge output in the OFF state with no bias voltages applied to the discharge electrode 91 and to the grid 92.

TABLE 2

| | | Full color | Two colors | Single color | Single color half-tone |
|---|---|---|---|---|---|
| Toner layer surface electric potential after primary transfer (V) | | −205 | −172 | −92 | −31 |
| Toner layer surface electric potential before second transfer (V) | | −205 | −172 | −92 | −31 |
| Image quality | Second transfer 3 kV | Generation of density unevenness and toner scattering | Generation of density unevenness and toner scattering | Good | Good |
| | Second transfer 4 kV | Generation of discharge tracks | Generation of discharge tracks | Generation of discharge tracks | Generation of discharge tracks |

As has been shown in Table 2, when a voltage of +3 kV is set as the second transfer voltage causing no generation of discharge tracks and this voltage is applied as the bias voltage to the second transfer section 11, the transfer electric field becomes insufficient thereby generating density unevenness in the high toner quantity adhesion areas and toner scattering at the border of the image areas. In order to prevent the generation of density unevenness in the high toner quantity adhesion areas and toner scattering at the border of the image areas, if the second transfer voltage is set as +4 kV, there was generation of discharge tracks.

COMPARABLE EXAMPLE 2

The test was made by carrying out neutralizing charging of the corotron type removing the grid and by applying a voltage of 4 kV AC superimposed on +1.5 kV DC on the neutralizing charger electrode 91.

TABLE 3

| | | Full color | Two colors | Single color | Single color half-tone |
|---|---|---|---|---|---|
| Toner layer surface electric potential before the neutralizing charge (V) | | −205 | −172 | −92 | −31 |
| Toner layer surface electric potential after the neutralizing charge (V) | | −127 | −116 | −67 | −10 |
| Image quality | Second transfer 3 kV | Good | Good | Generation of image roughness | Generation of image roughness |

TABLE 3-continued

| | | Full color | Two colors | Single color | Single color half-tone |
|---|---|---|---|---|---|
| | Second transfer 4 kV | Generation of discharge tracks | Generation of discharge tracks | Generation of discharge tracks and image roughness | Generation of discharge tracks and image roughness |

As has been shown in Table 3, when a voltage of +3 kV is set as the second transfer voltage causing no generation of discharge tracks and this voltage is applied as the bias voltage to the second transfer section 11, although the density unevenness in the high toner quantity adhesion areas and toner scattering at the border of the image were improved, there was a large reduction in the toner layer surface electric potential in the half-tone areas and image roughness were generated. When the second transfer voltage is set at +4 kV, discharge tracks were generated and image roughness occurred at the low toner quantity adhesion areas.

In the above preferred embodiment, although wire-shaped discharge electrode 91 was used in the neutralizing charger section 11 prior to the second transfer, the present invention shall not be construed to be limited to this, but it is possible to use needle-shaped or saw-tooth shaped discharge electrode etc.

Effect of the Embodiment

In the color image forming apparatus according to the present preferred embodiment, a scorotron type neutralizing charger section prior to second transfer (hereinafter referred to merely as neutralizing charger section) is provided on the upstream side of the second transfer section, a DC voltage with a polarity opposite to that of the toner is applied to the discharge electrode thereby causing discharge, a voltage opposite in polarity to that of the toner is applied to the grid, and a voltage is applied to the grid so that the toner image surface electric potential is reduced selectively in the image areas with higher surface electric potentials than a specific set toner image surface electric potential while the toner image surface electric potentials remain almost unchanged in the image areas with lower surface electric potentials than a specific set toner image surface electric potential. Because of this, since it is possible not only to suppress both the density roughness in the high toner quantity adhesion areas but also to maintain the toner image surface electric potentials before neutralizing charging in the areas with low toner quantity adhesion such as half-tone area, it was possible to obtain satisfactory second transfer images with no generation of image roughness or toner scattering.

What is claimed is:

1. An image forming apparatus comprising:

an image forming section for forming a toner image with toner particles having a first electric polarity;

an intermediate transfer body for bearing the toner image;

a first transfer section for transferring the toner image from the image forming section to the intermediate transfer body;

a second transfer section for transferring the toner image from the intermediate transfer body to a recording medium;

a charger for applying an electric charge to the toner image on the intermediate transfer body before the toner image is transferred to the recording medium; and a charge control section for applying a voltage to the charger, the voltage being suitable for lowering an electric surface potential of a high density portion of the toner image and for substantially preventing an electric surface potential of a low density portion of the toner image from lowering;

a sensor for sensing an electric surface potential of at least one of the intermediate transfer body or a portion where toner particles are adhered on the intermediate transfer body; and a control section for, based on the surface electric potential sensed by the sensor, controlling the charge control section to adjust the voltage applied to the charger.

2. The image forming apparatus of claim 1, wherein the control section controls the image forming section to form a toner image capable of forming a maximum density portion and a minimum density portion on the intermediate transfer body, controls the sensor to sense an electric surface potentials of the maximum density portion and the minimum density portion of the toner image sensed by the sensor.

3. The image forming apparatus of claim 1, wherein the image forming section comprises a plurality of image forming units for forming toner images different in color, respectively.

4. The image forming apparatus of claim 3, wherein the image forming units comprises a cyan image forming unit for forming an image of cyan color, a magenta image forming unit for forming an image of magenta color, and a yellow image forming unit for forming an image of yellow color.

5. The image forming apparatus of claim 4, wherein the image forming units further comprises a black image forming unit for forming an image of black color.

6. The image forming apparatus of claim 4, wherein the toner images different in color are layered on the intermediate transfer body to form a color toner image.

7. The image forming apparatus of claim 6, wherein the color toner image is transferred to the recording medium by the second transfer section.

8. The image forming apparatus of claim 1, wherein the intermediate transfer body comprises a belt.

* * * * *